US011255517B2

(12) United States Patent
Lam

(10) Patent No.: US 11,255,517 B2
(45) Date of Patent: Feb. 22, 2022

(54) ANTI-PULL-APART DECORATIVE LAMP AND ANTI-PULL-APART LAMP STRING

(71) Applicant: Season Bright (Cambodia) Electronic Lighting Co., Ltd, Svay Rieng Pro. (KH)

(72) Inventor: Su Io Lam, Svay Rieng Pro. (KH)

(73) Assignee: SEASON BRIGHT (CAMBODIA) ELECTRONIC LIGHTING CO., LTD, Bavet (KH)

( * ) Notice: Subject to any disclaimer, the term of this patent is extended or adjusted under 35 U.S.C. 154(b) by 0 days.

(21) Appl. No.: 16/939,322

(22) Filed: Jul. 27, 2020

(65) Prior Publication Data

US 2022/0010947 A1 Jan. 13, 2022

(30) Foreign Application Priority Data

Jul. 7, 2020 (CN) ..... 202010644466.0

(51) Int. Cl.

| | |
|---|---|
| ***F21K 9/238*** | (2016.01) |
| ***F21V 19/00*** | (2006.01) |
| ***F21S 4/10*** | (2016.01) |
| ***F21V 23/00*** | (2015.01) |

(52) U.S. Cl.

CPC ..... *F21V 19/0025* (2013.01); *F21S 4/10* (2016.01); *F21V 19/0005* (2013.01); *F21V 23/003* (2013.01)

(58) Field of Classification Search

None

See application file for complete search history.

(56) References Cited

U.S. PATENT DOCUMENTS

| | | | | |
|---|---|---|---|---|
| 6,340,306 | B1 * | 1/2002 | Daoud | H01R 13/6273 439/219 |
| 8,371,721 | B2 * | 2/2013 | Huang | F21K 9/232 362/311.02 |
| 2004/0165384 | A1 * | 8/2004 | Allen | F21V 5/04 362/267 |
| 2009/0146167 | A1 * | 6/2009 | Allen | F21V 31/04 257/98 |
| 2017/0003014 | A1 * | 1/2017 | Liu | F21S 4/10 |
| 2018/0328544 | A1 * | 11/2018 | Rieder | F21K 9/232 |
| 2019/0017659 | A1 * | 1/2019 | Dendorfer | F21V 3/02 |

* cited by examiner

*Primary Examiner* — Elmito Breval

(74) *Attorney, Agent, or Firm* — Epstein Drangel LLP; Robert L. Epstein

(57) ABSTRACT

Disclosed are an anti-pull-apart decorative lamp and an anti-pull-apart lamp string. The anti-pull-apart decorative lamp includes a light source, a connecting wire, a conductive terminal, and an insulating plastic. The anti-pull-apart lamp string includes anti-pull-apart decorative lamps and a cable. The light source includes a light-emitting chip and a lead wire frame with a first end electrically connected to the light-emitting chip, and a second end at which a pin is provided. The connecting wire includes a conducting wire and an insulating layer, the conducting wire at one end of the connecting wire protrudes from the insulating layer and forms a wiring connector. A first end of the conductive terminal is provided with a first clip, a second end of the conductive terminal is provided with a second clip, the first clip is roll-pressed against the pin, and the second clip is roll-pressed against the wiring connector.

18 Claims, 7 Drawing Sheets

ANTI-PULL-APART DECORATIVE LAMP AND ANTI-PULL-APART LAMP STRING

TECHNICAL FIELD

The present disclosure relates to the field of lamp technology, and in particular, to an anti-pull-apart decorative lamp and an anti-pull-apart lamp string.

BACKGROUND

In an existing landscape decorative lamp, a pin-package light-emitting diode (LED) is usually used as a light source device. A lead wire frame is used as a pin in the pin-package LED. Such a packaging structure is the earliest one developed successfully and put on the market. The packaging structure has many varieties and relatively high technological maturity, and is the most convenient and economical solution in the lamp industry at present. However, in most commercially available decorative lamps using a pin-package LED, the pin-package LED is directly soldered to a power cable. Due to the poor anti-pull capability of solder, in the outdoor environment with strong wind force or when children often pull and play with it, the connection mode of soldering is easy to cause the pin-package LED to fall off from the power cable, exposing a conductive part of the power cable to the air, which is easy to cause the danger of electric shock and pose a threat to personal safety. In addition, pseudo soldering is likely to occur when the pin-package LED is connected by solder tin. As a result, the pin-package LED emits light abnormally, adversely affecting the appearance of a decorative lamp.

SUMMARY

The present disclosure aims at solving one of the technical problems in the related art. In view of this, the present disclosure provides an anti-pull-apart decorative lamp and an anti-pull-apart lamp string, which have good anti-pull-apart performance and can prevent the occurrence of pseudo soldering.

According to an embodiment of a first aspect of the present disclosure, an anti-pull-apart decorative lamp is provided including:

a light source including a light-emitting chip and a lead wire frame, the lead wire frame having a first end electrically connected to the light-emitting chip and a second end at which a pin is provided;

a connecting wire including a conducting wire and an insulating layer, the insulating layer covering a side wall of the conducting wire, the conducting wire at one end of the connecting wire protruding from the insulating layer and forming a wiring connector, and the other end of the connecting wire being electrically connected to a drive power supply;

a conductive terminal having a first end provided with a first clip and a second end provided with a second clip, the first clip being roll-pressed against the pin, and the second clip being roll-pressed against the wiring connector; and an insulating plastic surrounding the wiring connector, the pin, and the conductive terminal, the insulating plastic being configured for preventing the pin from short-circuiting and/or electric leakage.

The anti-pull-apart decorative lamp according to the embodiment of the first aspect of the present disclosure at least has the following beneficial effects:

The pin of the lead wire frame is provided on the first clip, and the first clip surrounds the pin and is in tight contact with the pin, so that a frictional force between the first clip and the pin is used to fasten the lead wire frame at one end of the conductive terminal. The wiring connector of the connecting wire is provided on the second clip, and the second clip surrounds the wiring connector and is in tight contact with the wiring connector, so that a frictional force between the second clip and the wiring connector is used to fasten the connecting wire at the other end of the conductive terminal. The conducting wire of the connecting wire is electrically connected to the light-emitting chip of the light source by the conductive terminal. The surfaces of the wiring connector, the pin, and the conductive terminal are covered with the insulating plastic, which can prevent the pin from short-circuiting, prevent the wiring connector, the conductive terminal, and the pin from electric leakage, and can reinforce the connection between the conductive terminal and the pin as well as the wiring connector. The conductive terminal holds the pin and the wiring connector tightly by the first clip and the second clip, so that the anti-pull capability can be improved. In addition, the wiring connector can be electrically connected to the pin without soldering, thereby effectively avoiding pseudo soldering. The anti-pull-apart decorative lamp according to the embodiment of the first aspect of the present disclosure has a simple structure and low manufacturing cost.

In some embodiments of the present disclosure, the conductive terminal is provided with a connecting sheet having one end connected to the first clip and the other end connected to the second clip, and the wiring connector is electrically connected to the pin indirectly by the connecting sheet.

In some embodiments of the present disclosure, a portion of the first clip connected to the connecting sheet is arc-shaped, and two sides of the first clip perpendicular to an axial direction of the conductive terminal bend toward a same surface of the first clip.

In some embodiments of the present disclosure, a portion of the second clip connected to the connecting sheet is arc-shaped, and two sides of the second clip perpendicular to the axial direction of the conductive terminal bend toward a same surface of the second clip.

In some embodiments of the present disclosure, the conductive terminal further includes a third clip, the third clip is connected to an end of the second clip away from the connecting sheet, the second clip is configured for being roll-pressed against the conducting wire near the wiring connector, and the third clip is configured for being roll-pressed against the insulating layer near the wiring connector.

In some embodiments of the present disclosure, a portion of the third clip connected to the second clip is arc-shaped, and two sides of the third clip perpendicular to the axial direction of the conductive terminal bend toward a same surface of the third clip.

In some embodiments of the present disclosure, a length of the first clip in a circumferential direction of the conductive terminal is greater than or equal to a circumferential length of the pin, and a length of the second clip in the circumferential direction of the conductive terminal is greater than or equal to a circumferential length of the conducting wire.

In some embodiments of the present disclosure, a surface of the insulating plastic away from the conductive terminal is wrapped with a plastic layer, and the plastic layer is configured for encapsulating the insulating plastic inside the plastic layer.

In some embodiments of the present disclosure, the conductive terminal is made of copper or a copper-containing alloy.

An anti-pull-apart lamp string according to an embodiment of a second aspect of the present disclosure is provided including a plurality of anti-pull-apart decorative lamps in the embodiment of the first aspect and a cable, the cable being electrically connected to the connecting wire, the cable being provided with a power interface, and the power interface being configured for connecting a drive power supply.

The anti-pull-apart lamp string according to the embodiment of the second aspect of the present disclosure at least has the following beneficial effects:

The cable is provided with the connecting wire which is connected to the pin of the light source by the conductive terminal, so that the light source has a good anti-pull capability, and at the same time pseudo soldering can be avoided. The surfaces of the pin of the light source, the conductive terminal, and the wiring connector of the connecting wire are covered with the insulating plastic, which prevent the pin from short-circuiting, prevent electric leakage, and improve the anti-pull capability. The anti-pull-apart lamp string of the present disclosure can be arranged in occasions with large wind force or a large number of children. Because the anti-pull-apart lamp string of the present disclosure has good anti-pull performance, the light source can be prevented from being pulled off to avoid electric leakage at the cable. The power interface of the cable can be connected to a drive power supply with a voltage higher than the human body safety voltage.

Advantages and additional aspects of the present disclosure are partially provided in the following description and partially become apparent from the following description or understood through the practice of the present disclosure.

BRIEF DESCRIPTION OF THE DRAWINGS

The foregoing and/or additional aspects and advantages of the present disclosure will be apparent and easily comprehensible from the description of the embodiments with reference to the accompanying drawings, in which.

DETAILED DESCRIPTION

The embodiments of the present disclosure are described below in detail. Examples of the embodiments are shown in the accompanying drawings. The same or similar numerals represent the same or similar elements or elements having the same or similar functions throughout the specification. The embodiments described below with reference to the accompanying drawings are exemplary, and are only used to explain the present disclosure but should not be construed as a limitation to the present disclosure.

In the description of the present disclosure, "first" and "second" described herein are used only for distinguishing the technical feature, but are not intended to indicate or imply relative importance or implicitly specify a quantity of indicated technical features or implicitly specify an order of indicated technical features.

In the description of the present disclosure, unless otherwise expressly defined, the terms such as "disposed", "mounted", and "connected" should be understood in a broad sense. For persons of ordinary skill in the art, specific meanings of the terms in the present disclosure may be appropriately determined with reference to the specific content in the technical solution.

An anti-pull-apart decorative lamp according to an embodiment of a first aspect of the present disclosure is described below in detail with reference to the accompanying drawings.

Figure 1:
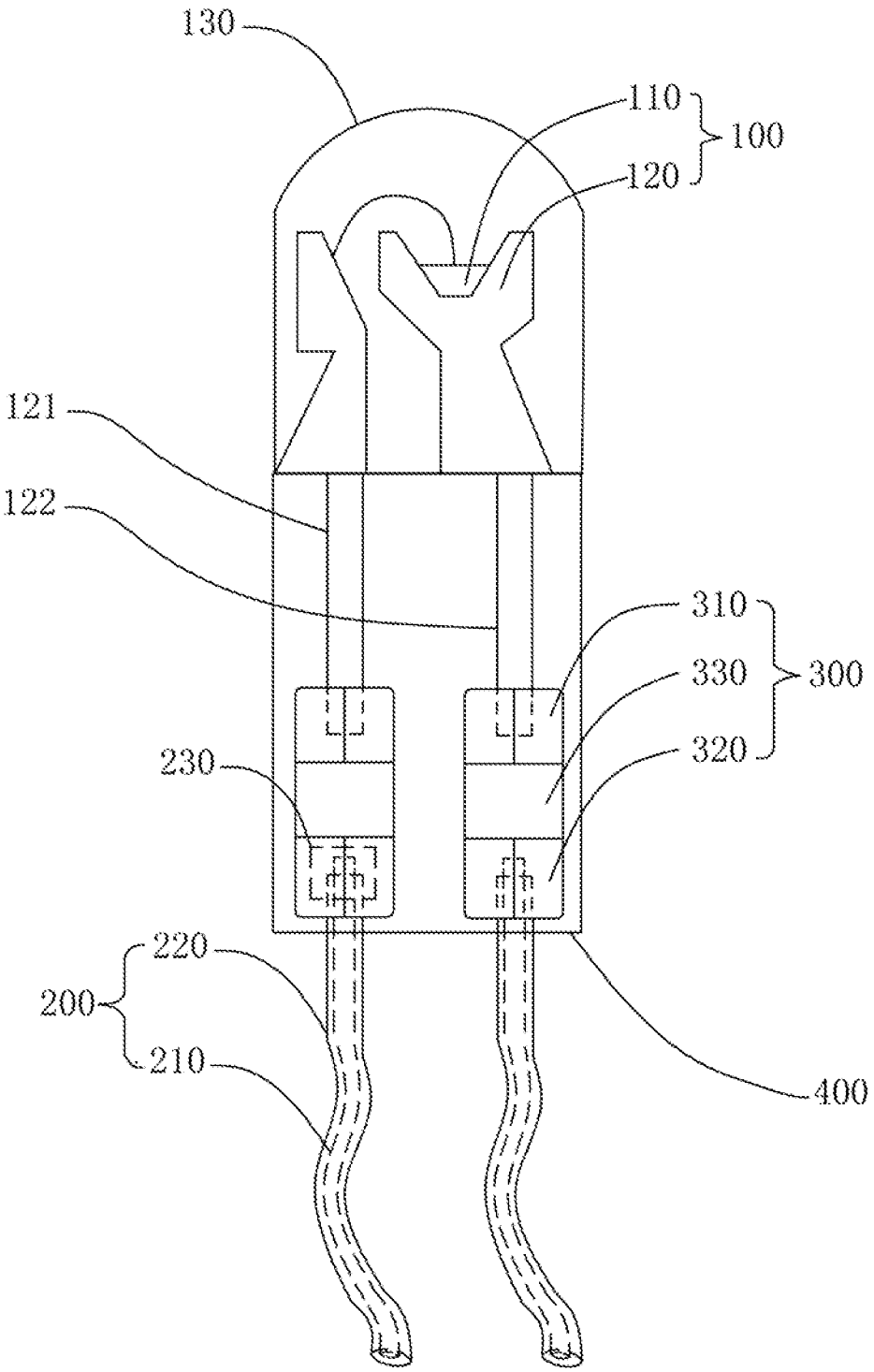
FIG. 1 is a schematic diagram of an anti-pull-apart decorative lamp according to an embodiment of the present disclosure.
Figure 2:
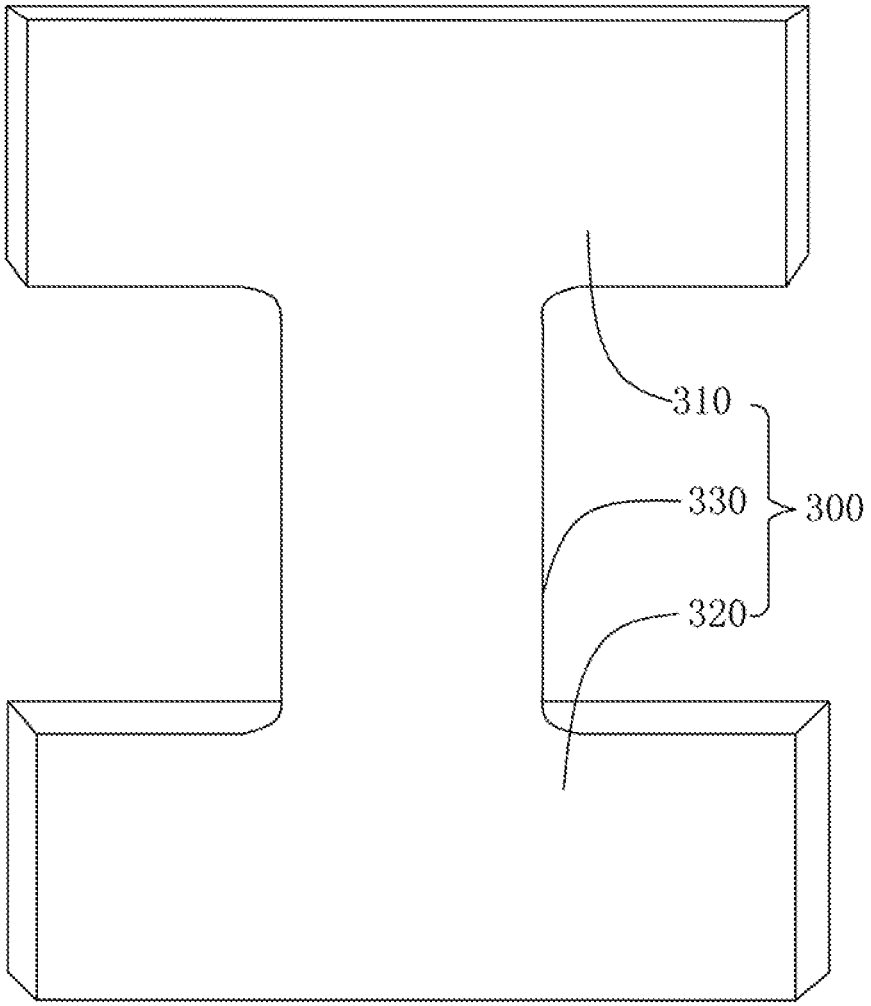
FIG. 2 is a schematic diagram of a conductive terminal according to an embodiment of the present disclosure.

Referring to FIG. 1 and FIG. 2, according to an embodiment of the present disclosure, an anti-pull-apart decorative lamp is provided, including: a light source 100, a connecting wire 200, a conductive terminal 300, and an insulating plastic 400. The light source 100 includes a light-emitting chip 110 and a lead wire frame 120. The lead wire frame 120 includes a first pin 121 and a second pin 122. An end of the first pin 121 is electrically connected to a positive electrode of the light-emitting chip 110. An end of the second pin 122 is electrically connected to a negative electrode of the light-emitting chip 110. The light-emitting chip 110 and an end of the lead wire frame 120 connected to the light-emitting chip 110 are encapsulated inside a transparent epoxy resin lampshade 130. In this embodiment, there are two conductive terminals 300. Two ends of the conductive terminal 300 are provided with a first clip 310 and a second clip 320 respectively. An end of each of the first pin 121 and the second pin 122 away from the lampshade 130 is provided on the first clip 310 of the respective conductive terminal 300. The first clip 310 tightly surrounds a respective one of the first pin 121 and the second pin 122 by taking an axial direction of the respective one of the first pin 121 and the second pin 122 as the axis. The first clip 310 fastens, by using a pressure and a frictional force, the respective one of the first pin 121 and the second pin 122 in a fastening ring formed by the first clip 310. The connecting wire 200 includes a conducting wire 210 and an insulating layer 220. The insulating layer 220 covers a side wall of the conducting wire 210. An end of the connecting wire 200 is provided with a wiring connector 230. The conducting wire 210 at the wiring connector 230 protrudes from the insulating layer 220. There are two connecting wires 200 in this embodiment, which are connected to a positive electrode and a negative electrode of a drive power supply. The wiring connector 230 is provided in the second clip 320 of the conductive terminal 300. The second clip 320 tightly surrounds the wiring connector 230 by taking an axial direction of the wiring connector 230 as the axis. The second clip 320 fastens, by using a frictional force, the wiring connector 230 in a fastening ring formed by the second clip 320. To prevent the first pin 121 and the second pin 122 from short-circuiting and prevent a portion of the lead wire frame 120 outside the lampshade 130, the conductive terminal 300, and the wiring connector 230 from discharging electricity to the outside, the surfaces of the portion of the lead wire frame 120 outside the lampshade 130, the conductive terminal 300, and the wiring connector 230 are covered with the insulating plastic 400. During actual production, the insulating plastic 400 may be injection-molded around the first pin 121, the second pin 122, the conductive terminal 300, and the wiring connector 230 in an injection molding manner. Alternatively, the insulating plastic 400 may be sleeved over the surfaces near the first pin 121, the second pin 122, the conductive terminal 300, and the wiring connector 230.

In addition, the conductive terminal 300 is provided with a connecting sheet 330 at a middle of the conductive terminal 300, with one end connected to the first clip 310 and the other end connected to the second clip 320. The first pin 121 and the second pin 122 are tightly clamped by the first clip 130 respectively. The wiring connector 230 of the connecting wire 200 is tightly clamped by the second clip 320. The wiring connector 230 is indirectly electrically connected with a respective one of the first pin 121 and the second pin 122 by the connecting sheet 330. The first clip 310 and the second clip 320 are independent of each other and do not affect each other. When a light source fails and needs to be replaced, it is only necessary to release the first clip 310 without affecting the connection between the second clip 320 and the wiring connector 230, which is convenient for maintenance and mass production. The first clip 310 and the second clip 320 are connected by the sheet-form connecting sheet 330, so that the resistance between the first clip 310 and the second clip 320 can be reduced, and the impact of the conductive terminal 300 on the brightness of the light source 100 can be reduced.

Further, the conductive terminal 300 is made of pure copper or a copper alloy, and the impedance between the light source 100 and the connecting wire 200 is reduced by the good conductivity and ductility of copper, so that the mechanical strength according to this embodiment is enhanced.

In the anti-pull-apart decorative lamp in this embodiment, the first pin 121 and the second pin 122 of the lead wire frame 120 and the wiring connector 230 of the connecting wire 200 are surrounded and tightly clamped by the first clip 310 and the second clip 320 of the conductive terminal 300 respectively, so that it is difficult to pull apart the light source 100 from the conductive terminal 300. Thus, the anti-pull-apart decorative lamp in this embodiment has good anti-pull capability and can avoid potential safety hazards caused by the connecting wire 200 being exposed to the air. It is not necessary to solder the light source 100 and the connecting wire 200 in this embodiment, so that the problem of pseudo soldering caused by soldering is avoided, and abnormal light emission caused by pseudo soldering can be avoided. The surfaces of the portion of the lead wire frame 120 outside the lampshade 130, the conductive terminal 300, and the wiring connector 230 are covered with the insulating plastic 400, so that the anti-pull capability in this embodiment can be further improved, to prevent the first pin 121 and the second pin 122 from being short-circuited due to compression. In addition, these parts can be prevented from discharging electricity to the outside to cause safety hazards. In the anti-pull-apart decorative lamp in this embodiment, the light source 100 may be solderlessly connected to the connecting wire 200, so that no toxic gas is generated during production, thereby reducing pollution to the environment.

Figure 3:
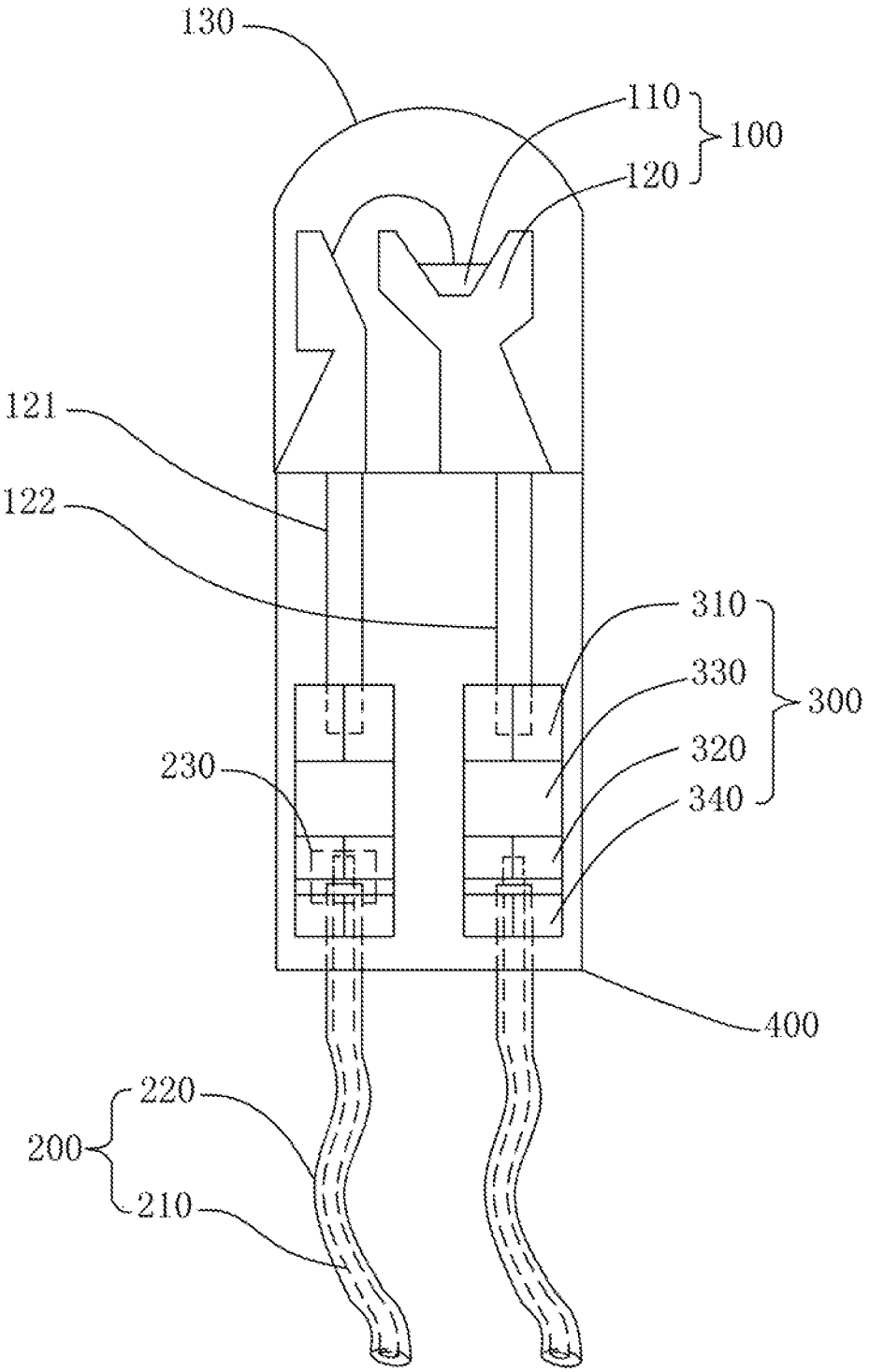
FIG. 3 is a schematic diagram of an anti-pull-apart decorative lamp according to another embodiment of the present disclosure.
Figure 4:
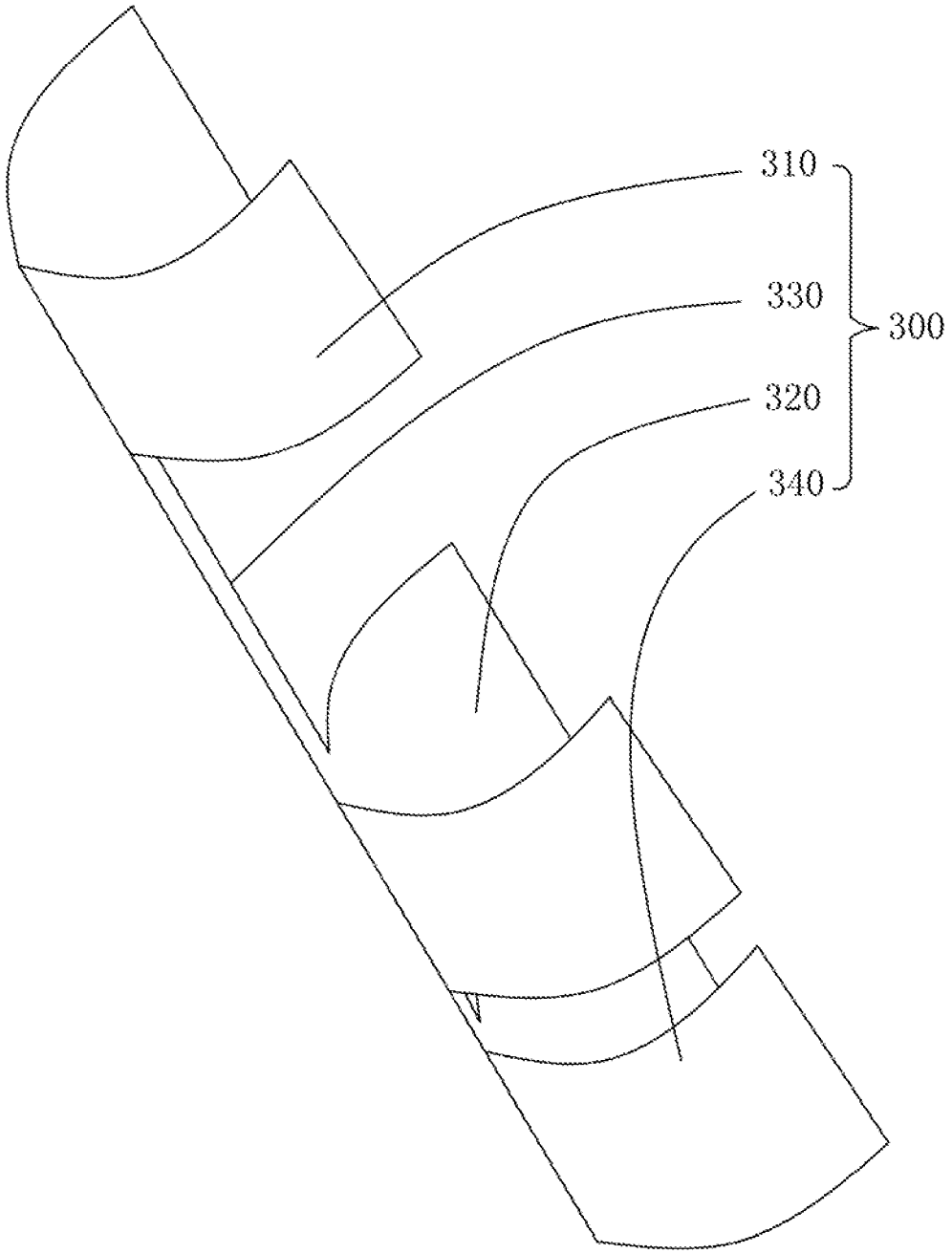
FIG. 4 is a schematic diagram of a conductive terminal according to another embodiment of the present disclosure.

Referring to FIG. 3 and FIG. 4, according to another embodiment of the present disclosure, an anti-pull-apart decorative lamp is provided. Based on the foregoing embodiment, an end of the second clip 320 away from the connecting sheet 330 is connected to a third clip 340. The second clip 320 and the third clip 340 are configured for tightly clamping the conducting wire 210 and the insulating layer 220 near the wiring connector 230, respectively. Specifically, the second clip 320 and the third clip 340 tightly surround the wiring connector 230 by taking an axial direction of the wiring connector 230 as the axis. The second clip 320 fastens, by using a frictional force, the conducting wire 210 near the wiring connector 230 in a fastening ring formed by the second clip 320. The third clip 340 fastens, by using a frictional force, the insulating layer 220 near the wiring connector 230 in a fastening ring formed by the third clip 340. Since the insulating layer 220 covers the side wall of the conducting wire 210, the insulating layer 220 has a diameter greater than that of the conducting wire 210. The second clip 320 and the third clip 340 roll-press and tightly clamp the conducting wire 210 and the insulating layer 220 at the wiring connector 230, so that contact areas between the second clip 320 and the conducting wire 210 and between the third clip 340 and the insulating layer 220 can be increased, to provide sufficient contact between the second clip 320 and the conducting wire 210 and between the third clip 340 and the insulating layer 220, thus preventing the insulating layer 220 from affecting the contact between the second clip 320 and the conducting wire 210, increasing the frictional force between the second clip 320 and the conducting wire 210, and improving the anti-pull capability of the anti-pull-apart decorative lamp in this embodiment.

Further, a portion of each of the first clip 310 and the second clip 320 connected to the connecting sheet 330 is arc-shaped. A portion of the third clip 340 connected to the second clip 320 is arc-shaped. Two sides of each of the first clip 310, the second clip 320, and the third clip 340 perpendicular to an axial direction of the conductive terminal 300 bend toward a same surface of the first clip 310, the second clip 320, and the third clip 340, to form a V-shaped structure with a curved bottom. Because the first pin 121 and the second pin 122 of the light source 100 as well as the conducting wire 210 and the insulating layer 220 of the connecting wire 200 are cylindrical structures, the first clip 310, the second clip 320, and the third clip 340 with an arc-shaped bottom can be in full contact with the surfaces of the first pin 121, the second pin 122, the conducting wire 210, and the insulating layer 220, to increase the frictional forces between the first clip 310 and the first pin 121 as well as the second pin 122, between the second clip 320 and the conducting wire 210, and between the third clip 340 and the insulating layer 220. Two sides of each of the first clip 310, the second clip 320, and the third clip 340 perpendicular to the axial direction of the conductive terminal 300 bend toward the same surface of the first clip 310, the second clip 320, and the third clip 340 respectively, which facilitates the machine to process the first clip 310, the second clip 320, and the third clip 340, making it easy for the first clip 310 to surround and press-fit on the first pin 121 and the second pin 122, for the second clip 320 to surround and press-fit on the conducting wire 210, and for the third clip 340 to surround and press-fit on the insulating layer 220. Therefore, the anti-pull-apart decorative lamp of this embodiment is applicable to large-scale production, thereby improving the production efficiency.

In addition, a length of the first clip 310 in a circumferential direction of the conductive terminal 300 is greater than or equal to circumferential lengths of the first pin 121 and the second clip 122 and a length of the second clip 320 in the circumferential direction of the conductive terminal 300 is greater than or equal to a circumferential length of the conducting wire 210, so that the first clip 310 and the second clip 320 can at least cover the surfaces of the first pin 121, the second pin 122, and the conducting wire 210 by one lap, which increases the contact areas between the first clip 310 and the first pin 121 as well as the second pin 122 and between the second clip 320 and the conducting wire 210 and thus increases the frictional forces between the first clip 310 and the first pin 121 as well as the second pin 122 and between the second clip 320 and the conducting wire 210, thereby improving the anti-pull capability in this embodiment.

Figure 5:
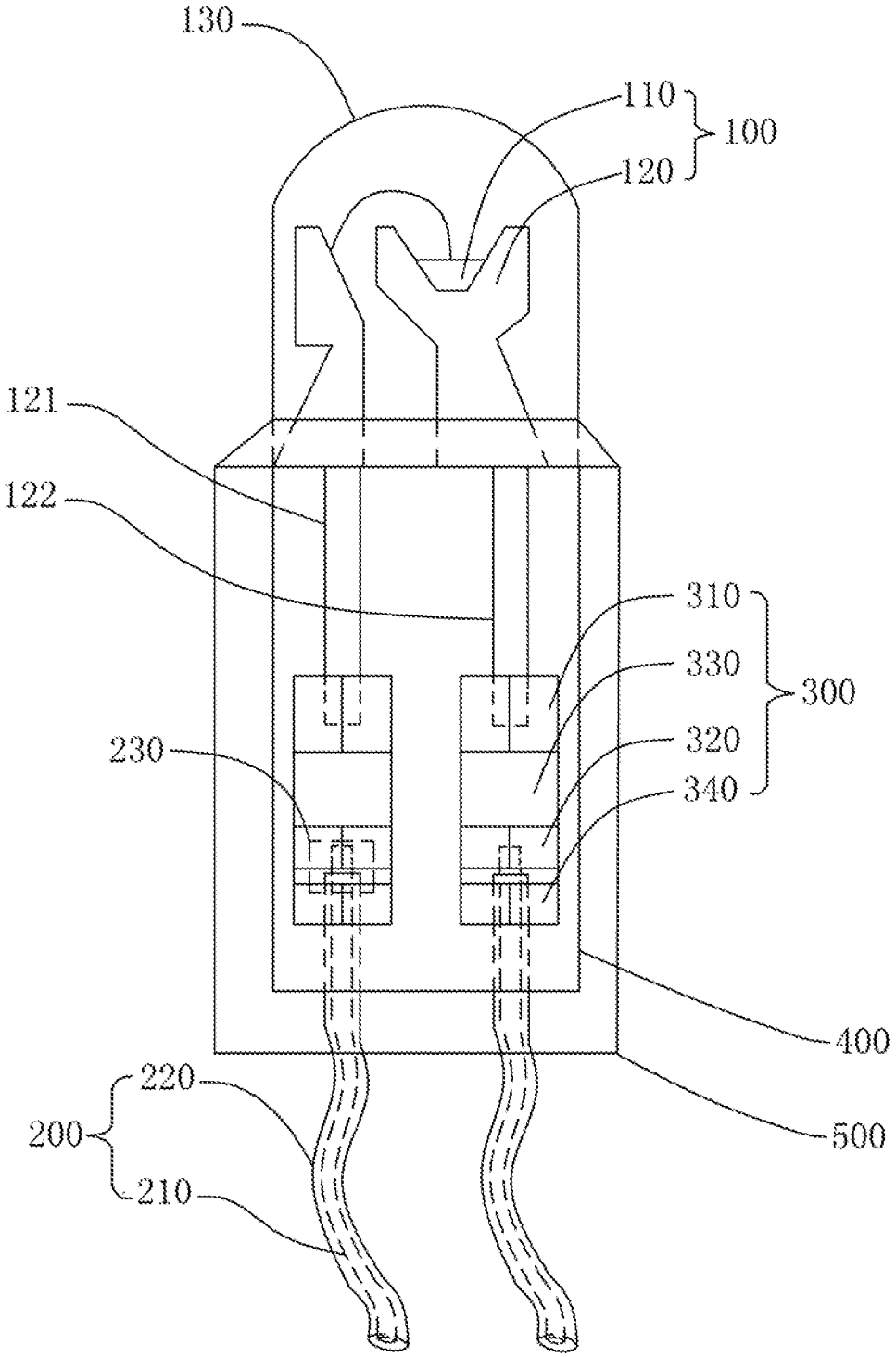
FIG. 5 is a schematic diagram of an anti-pull-apart decorative lamp according to another embodiment of the present disclosure.

Referring to FIG. 5, according to another embodiment of the present disclosure, an anti-pull-apart decorative lamp is provided. Based on the foregoing embodiment, a surface of the insulating plastic 400 away from the conductive terminal 300 is surrounded by a plastic layer 500. The plastic layer 500 encapsulates the insulating plastic 400 inside the plastic layer 500, so that the first pin 121, the second pin 122, the conductive terminal 300, and the wiring connector 230 are encapsulated inside the plastic layer 500, thereby improving the insulation performance of these parts. In addition, the plastic layer 500 may be designed into different forms, so that better appearance is achieved in this embodiment. For the plastic layer 500, a heat-sealed plastic tube may be adopted to be sleeved on the insulating plastic 400, and then heated to shrink and become tightly wrapped on the insulating plastic 400. Alternatively, various different forms may be injected on the surface of the insulating plastic 400 through injection molding.

An anti-pull-apart lamp string according to an embodiment of a second aspect of the present disclosure is described below in detail with reference to the accompanying drawings.

Figure 6:
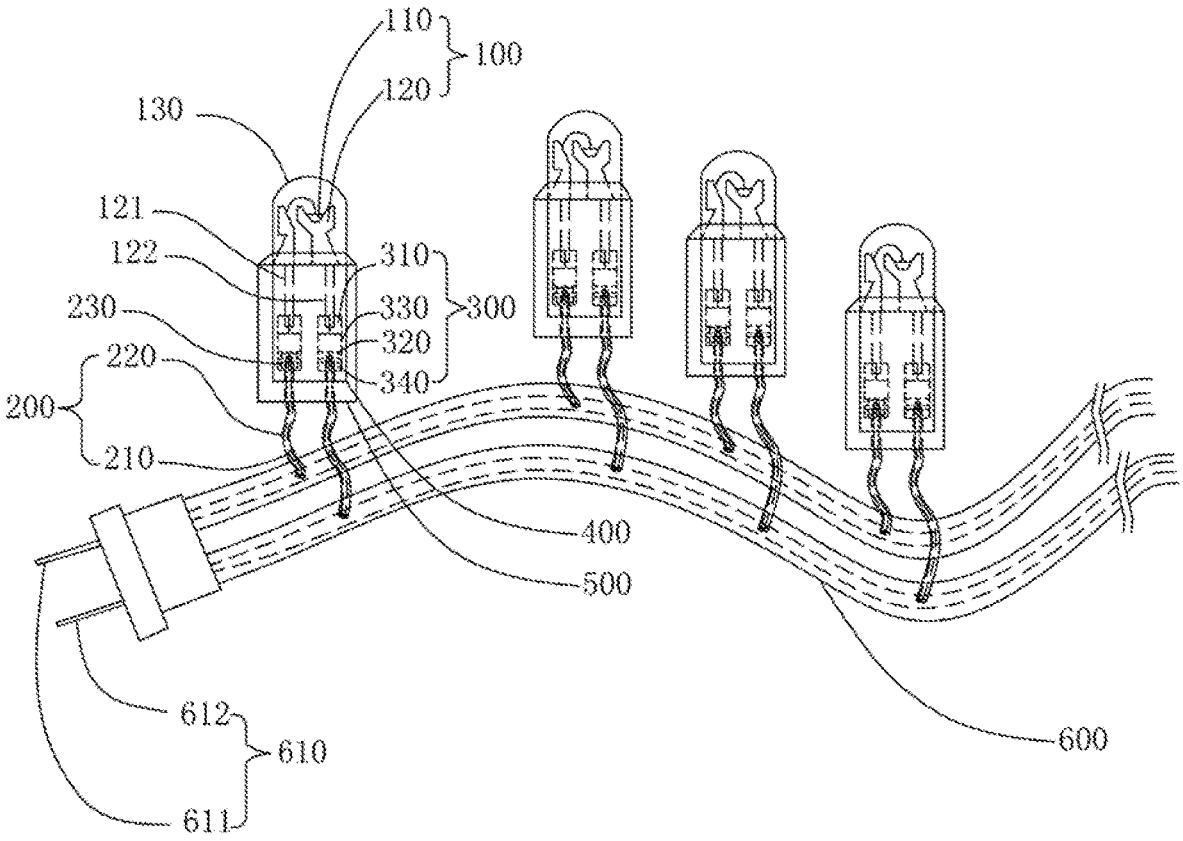
FIG. 6 is a schematic diagram of an anti-pull-apart lamp string according to an embodiment of the present disclosure.

Referring to FIG. 6, according to an embodiment of the present disclosure, an anti-pull-apart lamp string is provided, including the anti-pull-apart decorative lamp in the embodiment of the first aspect and a cable 600. In an axial direction of the cable 600, a pair of connecting wires 200 are led out at intervals. Each of the first pin 121 and the second pin 122 of the light source 100 is electrically connected to a respective one of the pair of connecting wires 200 by the conductive terminal 300. Light sources 100 are connected in parallel to the cable 600. One end of the cable 600 is provided with a power interface 610. The power interface 610 is provided with a positive terminal 611 and a negative terminal 612. The positive terminal 611 is electrically connected to the first pin 121 of the light source 100. The negative terminal 612 is electrically connected to the second pin 122 of the light source 100. The positive terminal 611 and the negative electrode 612 of the power interface 610 are electrically connected to a positive output terminal and a negative output terminal of a drive power supply, respectively. In this embodiment, since the light source 100 and the connecting wire 200 are connected by roll-pressing the conductive terminal 300, and the insulating plastic 400 is used around the conductive terminal 300, the first pin 121, the second pin 122, and the wiring connector 230 for fastening, the light source 100 has relatively high anti-pull performance, so that the risk of electric shocks caused by the exposure of the connecting wire 200 to the air due to the pulling-apart of the light source 100 can be avoided. Therefore, in this embodiment, a drive power supply with an output voltage of any value can be used for driving. In addition, the anti-pull-apart decorative lamps can be connected in parallel, so that the length of the cable 600 can be increased. Therefore, the anti-pull-apart lamp string of this embodiment can be arranged on a relatively long object and applied to different occasions.

Figure 7:
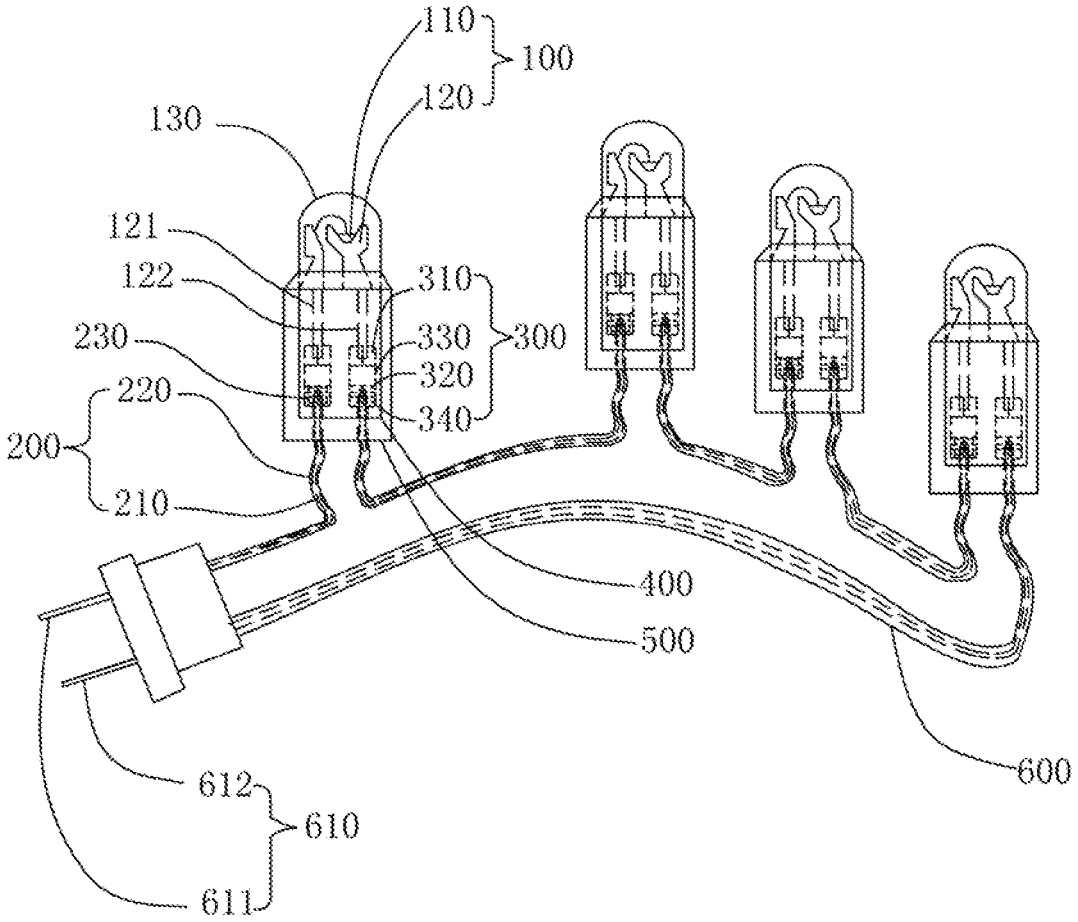
FIG. 7 is a schematic diagram of an anti-pull-apart lamp string according to another embodiment of the present disclosure.

Referring to FIG. 7, according to another embodiment of the present disclosure, an anti-pull-apart lamp string is provided, including the anti-pull-apart decorative lamp in the embodiment of the first aspect and a cable 600. One end of the cable 600 is provided with a power interface 610. The power interface 610 is provided with a positive terminal 611 and a negative terminal 612. The anti-pull-apart decorative lamp in the embodiment of the first aspect is connected to the connecting wire 200 of the cable 600 and is connected in series between the positive terminal 611 and the negative terminal 612 by the cable 600. Because the light source 100 is electrically connected to the connecting wire 200 of the cable 600 by the conductive terminal 300, it has a relatively high anti-pull performance, so that the risk of electric shocks caused by the exposure of connecting ends of the light source 100 and the cable 600 to the air due to the pulling-apart of the light source 100 can be avoided. Therefore, in this embodiment, a drive power supply with an output voltage of any value can be used for driving, so that the driving capability of the power supply or the quantity of serially connected lamps can be increased, thereby avoiding inadequate brightness caused by an excessively long cable 600 or an excessively large quantity of serially connected lamps, reducing the quantity of connected external power supplies, increasing the wiring length, and allowing the anti-pull-apart lamp string to be applied to different occasions.

The anti-pull-apart lamp string in this embodiment of the present disclosure includes the anti-pull-apart decorative lamp in any foregoing embodiment. Therefore, the anti-pull-apart lamp string in this embodiment of the present disclosure has the technical effects produced by the anti-pull-apart decorative lamp in any foregoing embodiment. Therefore, for specific technical effects of the anti-pull-apart decorative lamp in this embodiment of the present disclosure, reference may be made to the technical effects of the anti-pull-apart decorative lamp in any foregoing embodiment. Details are not described herein again.

The embodiments of the present disclosure are described above in detail with reference to the accompanying drawings. However, the present disclosure is not limited to the foregoing embodiments. Within the knowledge of a person of ordinary skilled in the art, various changes may further be made without departing from the principle of the present disclosure.

The invention claimed is:

1. An anti-pull-apart decorative lamp, comprising:

a light source comprising a light-emitting chip and a lead wire frame, the lead wire frame having a first end electrically connected to the light-emitting chip and a second end at which a pin is provided;

a connecting wire comprising a conducting wire and an insulating layer, the insulating layer covering a side wall of the conducting wire, the conducting wire at one end of the connecting wire protruding from the insulating layer and forming a wiring connector, and the other end of the connecting wire being electrically connected to a drive power supply;

a conductive terminal having a first end provided with a first clip, a second end provided with a second clip and a connecting sheet having one end connected to the first clip and the other end connected to the second clip, the first clip surrounding and being in tight contact with the pin, forming a frictional force between the first clip and the pin for fastening the lead wire frame at the first end of the conductive terminal, and the second clip surrounding and being in tight contact with the wiring connector forming a frictional force between the second clip and the wiring connector for fastening the connecting wire at the second end of the conductive terminal; the second end being opposite to the first end; and an insulating plastic surrounding the wiring connector, the pin, and the conductive terminal, the insulating plastic being configured for preventing the pin from short-circuiting and/or electric leakage;

wherein, the connecting sheet is elongate, thus forming two gaps between the first clip and the second clip, and the two gaps are separated from each other by the connecting sheet.

2. The anti-pull-apart decorative lamp of claim 1, wherein the wiring connector is electrically connected to the pin indirectly by the connecting sheet.

3. The anti-pull-apart decorative lamp of claim 2, wherein a portion of the first clip connected to the connecting sheet is arc-shaped, and two sides of the first clip perpendicular to an axial direction of the conductive terminal bend toward a same surface of the first clip.

4. The anti-pull-apart decorative lamp of claim 2, wherein a portion of the second clip connected to the connecting sheet is arc-shaped, and two sides of the second clip perpendicular to the axial direction of the conductive terminal bend toward a same surface of the second clip.

5. The anti-pull-apart decorative lamp of claim 2, wherein the conductive terminal further comprises a third clip, the third clip is connected to an end of the second clip away from the connecting sheet, the second clip is configured for being roll-pressed against the conducting wire near the wiring connector, and the third clip is configured for being roll-pressed against the insulating layer near the wiring connector.

6. The anti-pull-apart decorative lamp of claim 5, wherein a portion of the third clip connected to the second clip is arc-shaped, and two sides of the third clip perpendicular to the axial direction of the conductive terminal bend toward a same surface of the third clip.

7. The anti-pull-apart decorative lamp of claim 6, wherein a length of the first clip in a circumferential direction of the conductive terminal is greater than or equal to a circumferential length of the pin, and a length of the second clip in the circumferential direction of the conductive terminal is greater than or equal to a circumferential length of the conducting wire.

8. The anti-pull-apart decorative lamp of claim 1, wherein a surface of the insulating plastic away from the conductive terminal is surrounded by a plastic layer and the plastic layer is configured for encapsulating the insulating plastic inside the plastic layer.

9. The anti-pull-apart decorative lamp of claim 1, wherein the conductive terminal is made of copper or a copper-containing alloy.

10. An anti-pull-apart lamp string, comprising:

a plurality of anti-pull-apart decorative lamps, each comprising:

a light source comprising a light-emitting chip and a lead wire frame, the lead wire frame having a first end electrically connected to the light-emitting chip and a second end at which a pin is provided;

a connecting wire comprising a conducting wire and an insulating layer, the insulating layer covering a side wall of the conducting wire, the conducting wire at one end of the connecting wire protruding from the insulating layer and forming a wiring connector, and the other end of the connecting wire being electrically connected to a drive power supply;

a conductive terminal having a first end provided with a first clip, a second end provided with a second clip and an connecting sheet having one end connected to the first clip and the other end connected to the second clip, the first clip surrounding and being in tight contact with the pin, forming a frictional force between the first clip and the pin for fastening the lead wire frame at the first end of the conductive terminal, and the second clip surrounding and being in tight contact with the wiring connector forming a frictional force between the second clip and the wiring connector for fastening the connecting wire at the second end of the conductive terminal, for preventing; the second end being opposite to the first end; and an insulating plastic surrounding the wiring connector, the pin, and the conductive terminal, the insulating plastic being configured for preventing the pin from short-circuiting and/or electric leakage; and a cable, the cable being electrically connected to the connecting wire and provided with a power interface configured for connecting a drive power supply;

wherein, the connecting sheet is elongate, thus forming two gaps between the first clip and the second clip, and the two gaps are separated from each other by the connecting sheet.

11. The anti-pull-apart lamp string of claim 10, wherein the wiring connector is electrically connected to the pin indirectly by the connecting sheet.

12. The anti-pull-apart lamp string of claim 11, wherein a portion of the first clip connected to the connecting sheet is arc-shaped, and two sides of the first clip perpendicular to an axial direction of the conductive terminal bend toward a same surface of the first clip.

13. The anti-pull-apart lamp string of claim 11, wherein a portion of the second clip connected to the connecting sheet is arc-shaped, and two sides of the second clip perpendicular to the axial direction of the conductive terminal bend toward a same surface of the second clip.

14. The anti-pull-apart lamp string of claim 11, wherein the conductive terminal further comprises a third clip, the third clip is connected to an end of the second clip away from the connecting sheet, the second clip is configured for being roll-pressed against the conducting wire near the wiring connector, and the third clip is configured for being roll-pressed against the insulating layer near the wiring connector.

15. The anti-pull-apart lamp string of claim 14, wherein a portion of the third clip connected to the second clip is arc-shaped, and two sides of the third clip perpendicular to the axial direction of the conductive terminal bend toward a same surface of the third clip.

16. The anti-pull-apart lamp string of claim 15, wherein a length of the first clip in a circumferential direction of the conductive terminal is greater than or equal to a circumferential length of the pin, and a length of the second clip in the circumferential direction of the conductive terminal is greater than or equal to a circumferential length of the conducting wire.

17. The anti-pull-apart lamp string of claim 10, wherein a surface of the insulating plastic away from the conductive terminal is surrounded by a plastic layer and the plastic layer is configured for encapsulating the insulating plastic inside the plastic layer.

18. The anti-pull-apart decorative lamp of claim 10, wherein the conductive terminal is made of copper or a copper-containing alloy.

* * * * *